US011414990B2

(12) United States Patent
Young et al.

(10) Patent No.: US 11,414,990 B2
(45) Date of Patent: Aug. 16, 2022

(54) METHOD FOR PREDICTING BEHAVIOR OF A DEGRADABLE DEVICE, DOWNHOLE SYSTEM AND TEST MASS

(71) Applicants: Aaron Edward Young, Tomball, TX (US); Ricardo Arturo Barker Gomez, Houston, TX (US)

(72) Inventors: Aaron Edward Young, Tomball, TX (US); Ricardo Arturo Barker Gomez, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/864,368

(22) Filed: May 1, 2020

(65) Prior Publication Data

US 2021/0340868 A1 Nov. 4, 2021

(51) Int. Cl.
*E21B 49/08* (2006.01)

(52) U.S. Cl.
CPC ..... *E21B 49/0875* (2020.05); *E21B 49/081* (2013.01); *E21B 49/088* (2013.01)

(58) Field of Classification Search
CPC ..... G01N 17/04; E21B 47/00; E21B 25/00; E21B 10/58; E21B 17/042; E21B 49/0875; E21B 49/081; E21B 49/088; E21B 33/1291
See application file for complete search history.

(56) References Cited

U.S. PATENT DOCUMENTS

2010/0042327 A1* 2/2010 Garvey ..... E21B 47/00 702/11
2011/0203791 A1* 8/2011 Jin ..... E21B 17/042 166/244.1
2013/0140093 A1* 6/2013 Zhou ..... E21B 10/58 175/336
2016/0053564 A1* 2/2016 Haley ..... E21B 25/00 175/24
2017/0138169 A1 5/2017 Bogdan et al.
2017/0227451 A1* 8/2017 Hoegerl ..... G01N 17/04
2017/0292366 A1 10/2017 Ventura et al.
2017/0370176 A1* 12/2017 Frazier ..... E21B 33/1291
2018/0252067 A1 9/2018 Fripp et al.

FOREIGN PATENT DOCUMENTS

CN 109406335 A 3/2019
WO 2020032795 A1 2/2020

OTHER PUBLICATIONS

Nichols "Self-Removing Fracturing Plugs: A Study if Initial Adoption in the Williston Basin", Society of Pertoleum Engineers. (Year: 2017).*
International Search Report and Written Opinion; PCT/US2021/029883; dated Aug. 6, 2021; 9 pages.

* cited by examiner

*Primary Examiner* — Catherine T. Rastovski
*Assistant Examiner* — Kaleria Knox
(74) *Attorney, Agent, or Firm* — Cantor Colburn LLP

(57) ABSTRACT

A method of predicting behavior or a degradable device of a borehole tool when deployed downhole including introducing a test mass of material identical to the material of the degradable device to the same general location and at a time near to when the degradable device is deployed, removing the test mass from downhole, determining characteristics related to degradation of the test mass, and predicting degradation behavior of the degradable device based on the determined characteristics.

14 Claims, 3 Drawing Sheets

METHOD FOR PREDICTING BEHAVIOR OF A DEGRADABLE DEVICE, DOWNHOLE SYSTEM AND TEST MASS

BACKGROUND

In the resource recovery industry, it is becoming more and more desirable to employ degradable materials in various devices for use in the downhole environment to reduce operations related to removal of such devices. Degradable materials such as Magnesium, Aluminum, Polyglycolic Acid, controlled electrolytic metallic material (from Baker Hughes) all reduce operations such as milling in the borehole and can eliminate runs altogether. In theory, these are greatly beneficial but in practice, there is some difficulty in planning for timing that reduces the benefits achievable.

SUMMARY

An embodiment of a method of predicting behavior or a degradable device of a borehole tool when deployed downhole including introducing a test mass of material identical to the material of the degradable device to the same general location and at a time near to when the degradable device is deployed, removing the test mass from downhole, determining characteristics related to degradation of the test mass, and predicting degradation behavior of the degradable device based on the determined characteristics.

An embodiment of a downhole system including a degradable device made of a degradable material configured to be deployed downhole in a borehole tool, and a test mass of material identical to the material of the degradable device configured to be run downhole to the same general location and at a time near to when the degradable device is deployed, the test mass being retrievable from downhole for analysis of degradation of the test mass for use in predicting degradation behavior of the degradable device.

An embodiment of a test mass comprising material identical to a material of a degradable device, the test mass being configured to be run downhole to the same general location to where and a time near to when the degradable device is to be positioned, the test mass being configured to be more easily retrieved from downhole than the degradable device after being exposed to an environment similar to or the same as the environment the degradable device is exposed to while downhole.

BRIEF DESCRIPTION OF THE DRAWINGS

The following descriptions should not be considered limiting in any way.

With reference to the accompanying drawings, like elements are numbered alike.

DETAILED DESCRIPTION

A detailed description of one or more embodiments of the disclosed system, apparatus and method presented herein by way of exemplification and not limitation with reference to the Figures.

Degradable materials as noted above promise great efficiency but can also introduce timing problems. This is due to temperatures and chemical conditions (reactions, unplanned chemical additions, etc.) in a well that may not be precisely as anticipated or may vary by depth. Accordingly, selection of degradable material at a planning phase for a borehole system may not yield the results intended at the execution phase when a particular tool is deployed into the borehole. Systems, devices and methods disclosed herein address the foregoing.

Figure 1:
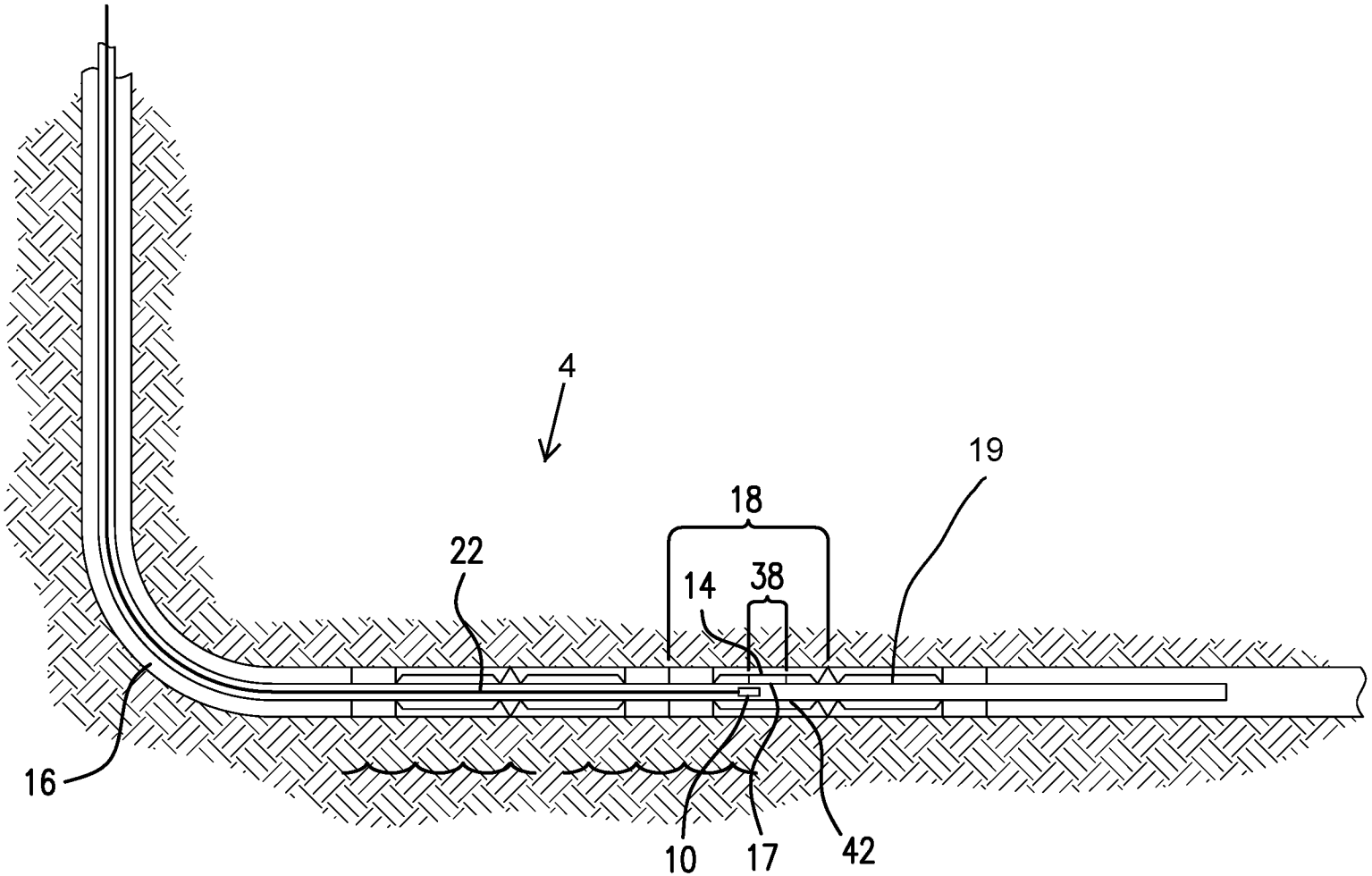
FIG. 1 depicts a test mass disclosed herein positioned within a borehole.

FIG. 1 illustrates a wellbore system 4 disclosed herein. The wellbore system 4, among other things, includes a degradable device 14 positioned within a borehole 16. The degradable device 14 may be used as a plug to block flow through an opening 17 in a portion 38 of a downhole tool 42, such as a casing 19 for example. Such a plug is useful as it allows pressure cycling to occur within the casing 19 during well operations. Once enough degradation of the degradable device 14 has occurred, flow is permitted through the opening 17. The opening 17 allows production fluids, such as hydrocarbons for example, to be produced.

A test mass 10 of material that is identical to a material of the degradable device 14 is run into the borehole 16 and is positioned at a same general location 18 as the degradable device 14. The test mass 10 is positioned at a time near to when the degradable device 14 is positioned within the borehole 16 so that the test mass 10 is bathed in an environment that is similar to the environment that the degradable device 14 is subjected to. While the degradable device 14 may be configured to stay downhole for its entire life, the test mass 10 is configured to be easily retrieved from the borehole 16. After removal the test mass 10 is analyzed to determine characteristics related to a rate of degradation thereof. This information can be used to determine a rate of degradation of the degradable device 14, including predicting when the degradable device 14 will be degraded to a point that will allow flow through the opening 17. The accurate prediction of behavior of degradation of the degradable device 14 allows a well operator to estimate precisely when the opening 17 of the portion 38 will be opened to flow as a result of degradation, and subsequent removal, of the degradable device 14. An operator can therefore plan further downhole operations based on the predicted degradation behavior.

Figure 3:
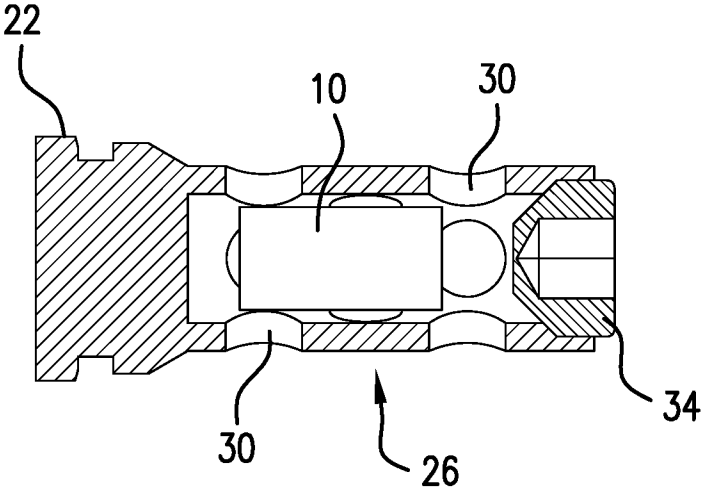
FIG. 3 is a cross-sectional view of FIG. 2.
Figure 2:
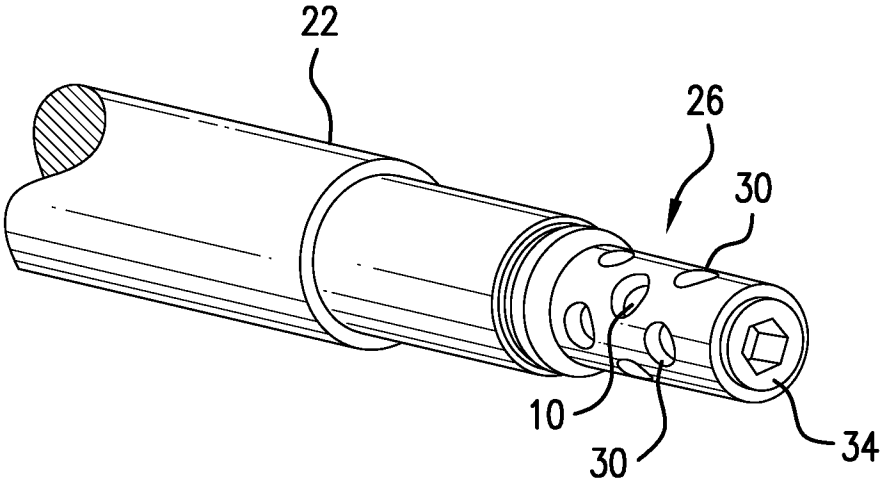
FIG. 2 is a perspective view of an embodiment of wireline including a test mass disclosed herein for use in a borehole.
Figure 4:
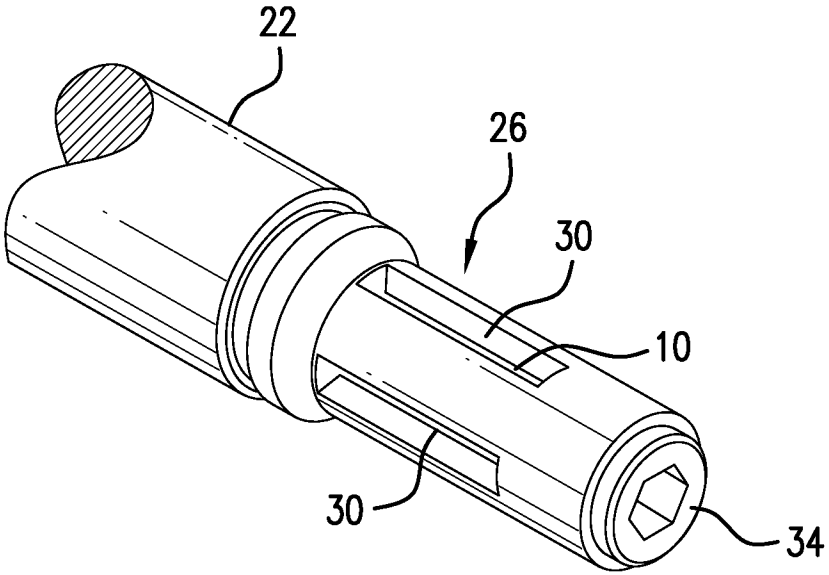
FIG. 4 is a perspective view of another embodiment of a wireline including a test mass for use in a borehole.

Referring now to FIGS. 2 through 4 in addition to FIG. 1, a wireline adapter kit 22, or similar apparatus is shown in detail. The wireline adapter kit 22 is designed to be expeditiously run into and out of the borehole 16. The wireline adapter kit 22 can be used to run tools such as the degradable device 14 into the borehole 16. It can also be used to run other things, such as the test mass 10, for example. These can both be run simultaneously or at separate times. For simplicity, the term wireline adapter kit 22 is used herein to refer to any tool configured to be quickly run into and out of the borehole 16.

In some embodiments the test mass 10 is easily removed from the wireline adapter kit 22 to further expedite analysis thereof after it is removed from downhole. In some embodiments, the test mass 10 is housed within a cage 26 of the wireline adapter kit 22. The cage 26 includes apertures 30 that allow the test mass 10 to be bathed in the environment, including access to fluids and temperatures that exist near the degradable device 14 at the location 18. A retainer 34, illustrated herein as a threaded member, is removably attached to the wireline adapter kit 22 to prevent the test mass 10 from exiting the cage 26 until such time that its removal is desired.

Figure 5:
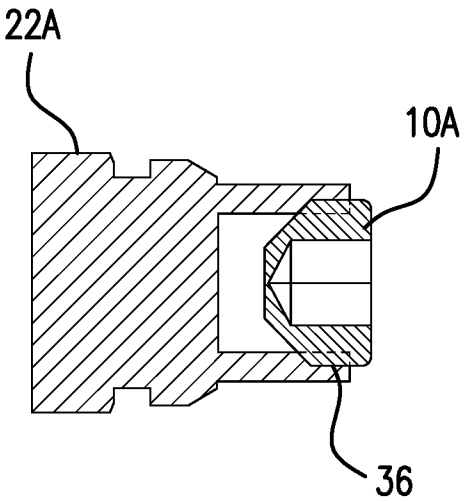
FIG. 5 is a cross-sectional view of another embodiment of a wireline including a test mass.

In an alternate embodiment, illustrated in FIG. 5, the test mass 10A is attached directly to the wireline adapter kit 22A, via threads 36. Other embodiments are contemplated for attaching the test mass 10A to the wireline adapter kit 22 that also avoid the need for a separate component to retain it.

As mentioned above, the wireline adapter kit 22 can be configured to place the degradable device 14 downhole in addition to running the test mass 10 into and out of the borehole 16. In such an embodiment the test mass 10 is run into the borehole 16 simultaneously with the degradable device 14. Running both the degradable device 14 and the test mass 10 into the hole in a single run avoids the possibility of exposing the test mass 10 to an environment that is different from the one the degradable device 14 is exposed to due to temporal changes in the environment.

Analysis of the test mass 10 includes determining characteristics of degradation behavior of the test mass 10. Such analysis allows one to predict behavior of degradation of the degradable device 14 with greater precision than possible without use of the test mass 10.

Set forth below are some embodiments of the foregoing disclosure:

Embodiment 1: A method of predicting behavior or a degradable device of a borehole tool when deployed downhole including introducing a test mass of material identical to the material of the degradable device to the same general location and at a time near to when the degradable device is deployed, removing the test mass from downhole, determining characteristics related to degradation of the test mass, and predicting degradation behavior of the degradable device based on the determined characteristics.

Embodiment 2: The method of any prior embodiment wherein the introducing the test mass is performed simultaneously with the deployment of the degradable device.

Embodiment 3: The method of any prior embodiment wherein the introducing the test mass is performed shortly before the deployment of the degradable device.

Embodiment 4: The method of any prior embodiment wherein the introducing the test mass is performed shortly after the deployment of the degradable device.

Embodiment 5: The method of any prior embodiment further comprising estimating when flow through an opening in a portion of the borehole tool, plugged by the degradable device, begins based on the predicted degradation behavior.

Embodiment 6: The method of any prior embodiment further comprising planning downhole operations based on the estimating.

Embodiment 7: A downhole system including a degradable device made of a degradable material configured to be deployed downhole in a borehole tool, and a test mass of material identical to the material of the degradable device configured to be run downhole to the same general location and at a time near to when the degradable device is deployed, the test mass being retrievable from downhole for analysis of degradation of the test mass for use in predicting degradation behavior of the degradable device.

Embodiment 8: The downhole system of any prior embodiment wherein the system is configured to deploy the degradable device and the test mass during a single run.

Embodiment 9: The downhole system of any prior embodiment wherein the degradable device is configured to block flow through an opening in a portion of the borehole tool until the degradable device is sufficiently degraded to allow flow through the opening in the portion of the borehole tool.

Embodiment 10: The downhole system of any prior embodiment wherein the test mass is mountable to a wireline adapter kit that can be easily run and retrieved from downhole.

Embodiment 11: The downhole system of any prior embodiment wherein the wireline adapter kit is configured to position the test mass at the same general location as the degradable device while allowing exposure of the test mass to fluid downhole near the degradable device.

Embodiment 12: The downhole system of any prior embodiment wherein the wireline adapter kit includes a cage that retains the test mass until its removal is desired.

Embodiment 13: The downhole system of any prior embodiment wherein the test mass it attached directly to the wireline adapter kit.

Embodiment 14: The downhole system of any prior embodiment wherein the attachment is via threads.

Embodiment 15: A test mass comprising material identical to a material of a degradable device, the test mass being configured to be run downhole to the same general location to where and a time near to when the degradable device is to be positioned, the test mass being configured to be more easily retrieved from downhole than the degradable device after being exposed to an environment similar to or the same as the environment the degradable device is exposed to while downhole.

Embodiment 16: The test mass of any prior embodiment wherein the test mass is attached to and removable from a wireline adapter kit that can be easily run and retrieved from downhole.

Embodiment 17: The test mass of any prior embodiment wherein the test mass is configured to be run downhole simultaneously with the degradable device.

Embodiment 18: The test mass of any prior embodiment wherein the test mass is configured to be easily analyzed for determining characteristics of degradation behavior.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of predicting behavior of a degradable device of a borehole tool when deployed downhole comprising:

introducing a test mass of material identical to the material of the degradable device to the same general location and at a time near to when the degradable device is deployed;

removing the test mass from downhole;

determining characteristics related to degradation of the test mass; and predicting degradation behavior of the degradable device based on the determined characteristics.

2. The method of claim 1 wherein the introducing the test mass is performed simultaneously with the deployment of the degradable device.

3. The method of claim 1 wherein the introducing the test mass is performed before the deployment of the degradable device.

4. The method of claim 1 wherein the introducing the test mass is performed after the deployment of the degradable device.

5. The method of claim 1 further comprising estimating when flow through an opening in a portion of the borehole tool, plugged by the degradable device, begins based on the predicted degradation behavior.

6. The method of claim 5 further comprising planning downhole operations based on the estimating.

7. A downhole system comprising:

a degradable device made of a degradable material configured to be deployed downhole in a borehole tool; and a test mass of material identical to the material of the degradable device configured to be run downhole to the same general location and at a time near to when the degradable device is deployed, the test mass being retrievable from downhole for analysis of degradation of the test mass for use in predicting degradation behavior of the degradable device.

8. The downhole system of claim 7 wherein the system is configured to deploy the degradable device and the test mass during a single run.

9. The downhole system of claim 7 wherein the degradable device is configured to block flow through an opening in a portion of the borehole tool until the degradable device is sufficiently degraded to allow flow through the opening in the portion of the borehole tool.

10. The downhole system of claim 7 wherein the test mass is mountable to a wireline adapter kit that can be easily run and retrieved from downhole.

11. The downhole system of claim 10 wherein the wireline adapter kit is configured to position the test mass at the same general location as the degradable device while allowing exposure of the test mass to fluid downhole near the degradable device.

12. The downhole system of claim 10 wherein the wireline adapter kit includes a cage that retains the test mass until its removal is desired.

13. The downhole system of claim 10 wherein the test mass it attached directly to the wireline adapter kit.

14. The downhole system of claim 13 wherein the attachment is via threads.

* * * * *